US005324032A

United States Patent [19]

Minami

[11] Patent Number: 5,324,032

[45] Date of Patent: Jun. 28, 1994

[54] GOLF CLUB SHAFT

[75] Inventor: Masanobu Minami, Chiba, Japan

[73] Assignee: Maruman Golf Kabushiki Kaisha, Tokyo, Japan

[21] Appl. No.: 113,916

[22] Filed: Aug. 31, 1993

Related U.S. Application Data

[63] Continuation of Ser. No. 812,614, Dec. 26, 1991, abandoned.

[30] Foreign Application Priority Data

Dec. 27, 1990 [JP] Japan ..... 2-407133

[51] Int. Cl.[5] ..... A63B 53/10

[52] U.S. Cl. ..... 273/80 B; 273/DIG. 23

[58] Field of Search ..... 273/80 R, 80 B, 77 R, 273/77 A, DIG. 23, 81 R

[56] References Cited

U.S. PATENT DOCUMENTS

| | | | |
|---|---|---|---|
| 1,611,925 | 12/1926 | Link | 273/81 R |
| 1,680,447 | 8/1928 | Bryant | 273/80 R |
| 4,188,032 | 2/1980 | Yanagioka | 273/80 R |
| 4,597,578 | 7/1986 | Lancaster | 273/81 R |
| 4,725,060 | 2/1988 | Iwanaga | 273/77 A |
| 4,836,545 | 6/1989 | Pompa | 273/80 B |
| 5,083,780 | 1/1992 | Walton et al. | 273/80 B |

*Primary Examiner*—Vincent Millin
*Assistant Examiner*—Sebastiano Passaniti
*Attorney, Agent, or Firm*—Armstrong, Westerman, Hattori, McLeland & Naughton

[57] ABSTRACT

A golf club shaft has a grip portion at which the shaft is to be fitted with a grip, and a tip at which the shaft is to be connected to a club head. The grip portion of the shaft and the neighborhood thereof are made of a composite material comprising a fiber-reinforced synthetic resin layer and a metal layer, while the remaining portion is made of a fiber-reinforced synthetic resin.

5 Claims, 1 Drawing Sheet

GOLF CLUB SHAFT

This application is a continuation application Ser. No. 07/812,614 filed Dec. 26, 1991, now abandoned.

BACKGROUND OF THE INVENTION

Field of the Invention

The present invention relates generally to a golf club shaft and, more particularly, to a golf club shaft which uses a suitable combination, of a fiber-reinforced synthetic resin layer and a metal layer at a grip portion and the neighborhood thereof.

Description of Related Art

Golf club shafts which are recently available are made of the following materials.

A. Metals

B. Synthetic resins reinforced by carbon fibers (CFRP)

C. Synthetic resins reinforced by composite fibers incorporating metal fibers or organic or inorganic fibers other than carbon fibers D. Composite materials composed of metals and CFRP; for instance a metal shaft wound thereon with CFRP throughout the overall length thereof.

As is well known in the art, the golf club shaft is a main constituent part of a golf club, and there are many attempts to improve the performance of the golf club shaft through improvements of the material used therefor and the structure thereof.

For improving the performance of the golf club shaft, the weight reduction of the shaft is important. The weight reduction of the golf club shaft can greatly contribute to increase the head speed and permits readier handling of the golf club for average golfers in comparison to heavier shafts.

When reducing the weight of the golf club shaft, however, it is important to avoid deterioration of various physical and sensual properties such as torsion rigidity, bending rigidity, vibration resistance at the time of impact, and sense of grip, i.e., a sense of firmly gripping a grip during the swing of the shaft. In the case that the club shaft is made of a material in item A, it is difficult to ensure the freedom of shaft design in relation to the weight reduction, torsion rigidity and hardness. Further, in this case the weight distribution of the shaft is inherently uniform, and there is no freedom of setting the gravity of the shaft to a position at which the player senses readiest swinging of the golf club. In the case that the club shaft is made of a material in item B, the player feels a sense of departure from swing harmony particularly when hitting a ball due to low rigidity of the shaft. Further, in this case the weight distribution of the shaft is substantially uniform, as similar to the shaft made of material in item A. The materials in item C can improve the drawback of the shaft made of a material in item B only to a certain extent, and can not greatly vary the weight distribution along the shaft. Further, the materials in item D can not be free from limitations imposed by the weight, and also the weight distribution of the shaft is substantially uniform.

SUMMARY OF THE INVENTION

Therefore, it is an object of the present invention to provide a golf club shaft which is light in weight and meets various performance requirements therefor.

In order to achieve the above-mentioned object, it is provided a golf club shaft having a grip portion at which the shaft is to be fitted with a grip, and a tip at which the shaft is to be connected to a club head, wherein the grip portion and the neighborhood thereof are made of a composite material comprising a fiber-reinforced synthetic resin (FRP) layer and a metal layer, while the remaining portion is made of a fiber-reinforced synthetic resin.

According to the above-mentioned construction, an golf club shaft is provided, which is light in weight and has the following properties.

1. The rigidity of the shaft grip portion can be improved compared to the prior art golf club shaft totally made of the FRP. Thus, the shaft is difficultly deformed and provides for an improved grip feeling, i.e., a sense of firmly gripping the grip.

2. In comparison to the prior art golf club shaft which is made of the FRP throughout the overall length thereof, it is possible to manufacture logically a golf club which can be swung readily by the player. That is, the gravity of the shaft can be set to a position at which the player senses readiest swinging, by varying the length of the portion using the metal.

The FRP may use various reinforcement fibers, for example, carbon fibers, organic fibers such as totally aromatic polyamide fibers, inorganic fibers such as glass fibers, or metal fibers such as titanium fibers. On the other hand, the metal layer may be made of carbonated steel, stainless steel or the like.

In the golf club shaft according to the invention, the total length of the grip portion and the neighborhood thereof may be set as desired by taking required performance to the shaft into considerations. Usually, the total length from 200 to 600 mm of the grip portion and the neighborhood thereof is sufficient.

Further objects, features and advantages of the present invention will become apparent from the following description of the preferred embodiments of the present invention as illustrated in the accompanying drawings.

DETAILED DESCRIPTION OF THE REFEREED EMBODIMENTS

Figure 1:
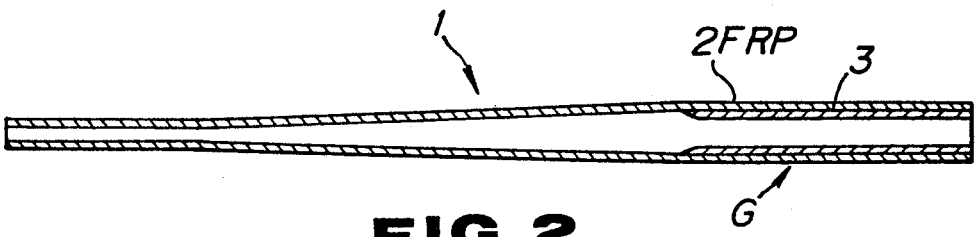
FIG. 1 is a sectional view showing a first embodiment of the golf club shaft according to the invention.

Referring to FIG. 1 there is shown a golf club shaft 1 according to a first embodiment of the invention.

The shaft 1 is formed in the form of a generally tapered pipe and has a grip portion G at which the shaft 1 is to be fitted or covered with a grip (not shown) such as tubular rubber grip, and a tip at which the shaft 1 is to be connected to a club head (not shown). The grip portion G of the shaft 1 and the neighborhood thereof have a laminated structure comprising a FRP layer 2 as an outer layer and an metal layer 3 as an inner layer, while the remaining portion of the shaft 1 is made of FRP. In this embodiment, the remaining portion of the shaft 1 is made of the same material as that of the outer FRP layer 2. Further, in this embodiment, the outer FRP layer 2 and the remaining portion of the shaft 1 have a constant thickness throughout the overall length of the shaft 1, while the inner metal layer 3 has substantially the same thickness as that of the outer FRP layer 2.

Figure 4:
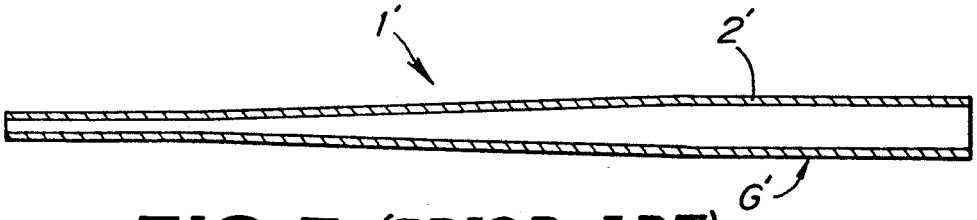
FIG. 4 (PRIOR ART)
FIG. 4 is a sectional view showing a golf club shaft in the prior art.

By virtue of the metal layer 3, the shaft 1 has at the grip portion G and the neighborhood thereof a high rigidity in comparison to a conventional shaft, for instance a shaft 1' shown in FIG. 4 which is made of only a FRP 2' throughout the overall length. Thus, the shaft 1 of the first embodiment can be difficultly deformed, and can effectively attenuate and absorb impact forces applied to the head at the time of an impact and transmitted to the shaft 1. Further, the grip feeling, i.e., sense of grip, of the shaft 1 at the grip portion G can be enhanced.

Further, while the double-layered structure according to the invention is adopted for the grip portion G of the shaft 1 and the neighborhood thereof, the total length of the grip portion G and the neighborhood thereof to which the laminated structure is applied may be varied suitably so as to obtain a shaft which can be swung best by each player.

Figure 5:
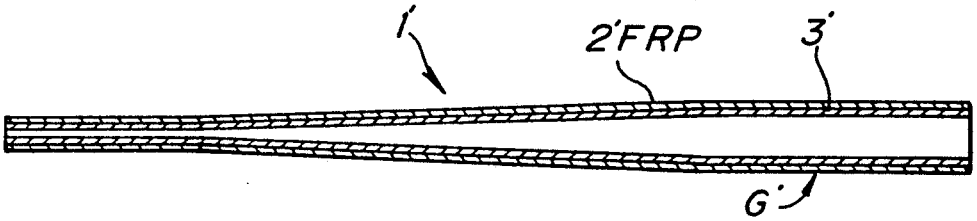
FIG. 5 (PRIOR ART)
FIG. 5 is a sectional view showing another golf club shaft in the prior art.

FIG. 5 shows an another conventional shaft 1' having a metal layer 3' which extends through the overall length of the shaft 1' and is wound at the outer surface thereof with a FRP sheet 2' throughout the overall length thereof. In the shaft 1' shown in FIG. 5, the weight distribution is substantially uniform throughout the shaft. In comparison to this, the gravity of the shaft 1 according to the invention can be set to a position at which the player senses readiest swinging, by varying the portion using the metal 3, that is, by varying the weight distribution of the shaft 1. Thus, according to the invention it is possible to manufacture the golf club matched to the player very logically.

Figure 2:
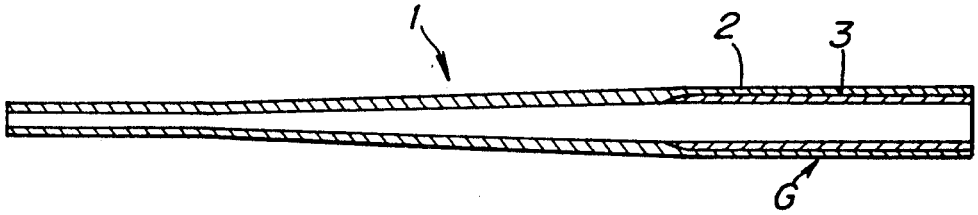
FIG. 2 is a sectional view showing a second embodiment of the golf club shaft according to the invention.

FIG. 2 shows a second embodiment of the golf club shaft 1 according to the invention. The shaft 1 of the second embodiment is different from the embodiment of FIG. 1 at the point that the thickness of the outer FRP layer 2 is smaller than that of the remaining portion of the shaft 1 and metal material 3 are varied.

Figure 3:
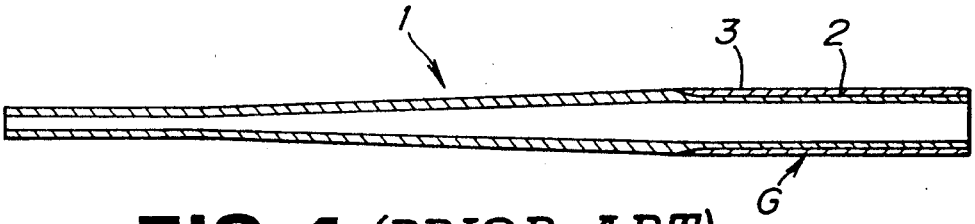
FIG. 3 is a sectional view showing a third embodiment of the golf club shaft according to the invention.

FIG. 3 shows a third embodiment of the golf club shaft 1 according to the invention. The shaft 1 of the third embodiment is different from the embodiment of FIG. 2 at the point that the grip portion G and the neighborhood thereof have a laminated structure comprising a FRP layer 2 as an inner layer and an metal layer 3 as an outer layer, while the remaining portion of the shaft 1 is made of FRP. In the third embodiment, the remaining portion of the shaft 1 is made of the same material as that of the inner FRP layer 2. Further, in the third embodiment, the inner FRP layer 2 and the remaining portion of the shaft 1 have a constant thickness throughout the overall length of the shaft 1, while the outer metal layer 3 has substantially the same thickness as that of the inner FRP layer 2.

While the invention has been described in conjunction with specific embodiments thereof, it is evident that many alternatives and modifications will be apparent to those skilled in the art in light of the foregoing description. For example, although in the above-mentioned embodiments, the grip portion G of the shaft 1 and the neighborhood thereof, as well as the tip portion has a constant outer diameter, while the portion between the neighborhood of the grip portion G and the tip portion has a tapered outer shape, the shaft 1 may have a tapered outer shape throughout the overall length thereof. Accordingly, it is intended to include all such alternatives and modifications as fall within the spirit and scope of the appended claims.

What is claimed is:

1. A golf club shaft in the form of a hollow tubular member and having two ends, one end having a grip portion at which the shaft is to be fitted with a grip and the other end having a tip at which the shaft is to be connected to a club head, said entire grip portion and a portion of the shaft adjacent to the grip portion being made of a composite material comprising an outer fiber-reinforced synthetic resin layer and an inner metal layer, the member further comprising a remaining portion including the tip, the remaining portion of the member being free of an inner metal layer and being made of a material the same as said outer fiber-reinforced synthetic resin layer, said remaining portion of the shaft and said outer fiber-reinforced synthetic resin layer being integrally formed with each other to form a continuous outer peripheral surface of the shaft.

2. The golf club shaft according to claim 1, wherein the total length of the composite material is in the range of 200–600 mm.

3. The golf club shaft according to claim 1, wherein said fiber-reinforced synthetic resin layer of the composite material has a thickness which is substantially equal to that of said fiber-reinforced synthetic resin of the remaining portion of the shaft.

4. The golf club shaft according to claim 1, wherein said fiber-reinforced synthetic resin layer of the composite material has a thickness which is smaller than that of said fiber-reinforced synthetic resin of the remaining portion of the shaft.

5. The golf club shaft according to claim 1, wherein said fiber-reinforced synthetic resin layer of the composite material is substantially equal to that of said metal layer.

* * * * *